US005769553A

United States Patent [19]

Chaudhri et al.

[11] Patent Number: 5,769,553

[45] Date of Patent: Jun. 23, 1998

[54] TOOTHBRUSH

[76] Inventors: Aslam Chaudhri; Nausheen Chaudhri; Saima Chaudhri, all of 10951 Gilbert Road, Richmond, British Columbia, Canada, V7E 2H4

[21] Appl. No.: 745,663

[22] Filed: Nov. 8, 1996

[51] Int. Cl.[6] ..... A46B 11/02

[52] U.S. Cl. ..... 401/195; 401/123; 401/125; 401/134; 401/173; 132/311

[58] Field of Search ..... 401/173, 134, 401/123, 125, 176, 195; 132/311

[56] References Cited

U.S. PATENT DOCUMENTS

| | | | |
|---|---|---|---|
| 1,349,110 | 8/1920 | Snyder | 132/311 |
| 1,442,662 | 1/1923 | Guinn | 401/173 |
| 1,642,620 | 9/1927 | Merrill | 401/123 X |
| 2,948,007 | 8/1960 | Tanguay | 401/173 |
| 3,356,095 | 12/1967 | Tylle | 401/134 X |
| 4,457,641 | 7/1984 | Smith | 401/173 X |
| 4,865,481 | 9/1989 | Scales | 401/195 |
| 4,957,125 | 9/1990 | Yaneza | 401/123 X |
| 5,044,386 | 9/1991 | Nelson | 132/309 |
| 5,304,009 | 4/1994 | Marshall | 401/268 |

FOREIGN PATENT DOCUMENTS

| | | | |
|---|---|---|---|
| 638951 | 6/1928 | France | 401/195 |
| 1466508 | 1/1967 | France | 401/173 |
| 2480099 | 10/1981 | France | 132/311 |
| 2588734 | 4/1987 | France | 401/134 |
| 512130 | 7/1956 | Italy | 401/176 |

*Primary Examiner*—Steven A. Bratlie
*Attorney, Agent, or Firm*—Brian M. Long

[57] ABSTRACT

A toothbrush has a first handle portion containing toothpaste and a movable handle portion projecting longitudinally through an end opening of the first handle portion and forming a ram for expelling the toothpaste through a passage in a bristle end portion of the toothbrush to outlet openings between bristles. The movable handle portion is in two relatively separable parts having mutually interengageable end portions releasably securing the parts together, one of the parts containing a mouthwash chamber with a supply of mouthwash and the other parts containing a floss chamber with a supply of dental floss. The movable handle is readily releasably secured to the first handle portion.

2 Claims, 2 Drawing Sheets

TOOTHBRUSH

BACKGROUND OF THE INVENTION

1. Field of the Invention

The present invention relates to toothbrushes and, more particularly, to toothbrushes of the type which contain a supply of toothpaste.

2. Description of the Related Art

In U.S. Pat. No. 4,865,481, issued to Joseph K. Scales, there is disclosed a combination disposable toothbrush including a dentrifice dispenser, a mouthwash container and a dental floss compartment. In this prior toothbrush, a pliable dentrifice dispenser, containing a single supply of dentrifice, is positioned laterally along one side of a bristle end of the toothbrush, opposite from bristles, and the dentrifice dispenser communicates through a flexible passageway with a conduit extending longitudinally of the bristle end so that, on compression of the pliable dentrifice dispenser, a single supply of dentrifice is displaced through the passageway and the conduit and through orifices so as to be pressed out laterally of the bristle end of the toothbrush for subsequent toothbrushing.

BRIEF SUMMARY OF THE INVENTION

According to the present invention, a toothbrush comprises a handle and an elongate bristle end portion extending from the handle, the bristle end portion having bristles projecting laterally therefrom, a passage extending longitudinally of the bristle end portion and outlet openings extending transversely of the bristle end portion from the passage to locations between the bristles end communicating with the exterior of the bristle end portion. The handle comprises a first handle portion connected to the bristle end portion and defining a toothpaste chamber communicating with the passage and the first handle portion has an end opening at an end thereof remote from the bristle end portion, a sealed pouch accommodated in the toothpaste chamber and containing the supply of toothpaste and a tube forming an extension of the passage, tie tube having a tapered end projecting into the toothpaste chamber so as to pierce the pouch and thereby provide communication between the passage and the supply of toothpaste. The handle includes a moveable handle portion projecting longitudinally through the end opening, the moveable handle portion comprising a ram forming an end of the moveable handle portion located in the toothpaste chamber, and the movable handle portion comprises two relatively separable parts, which have mutually interengageable end portions releasably securing the parts together in end-to-end relation, one of the parts containing a mouthwash chamber with a supply of mouthwash and the other of the parts containing a floss chamber with a supply of dental floss. The first handle portion has an internal screw thread extending from the end opening and along the toothpaste chamber and the movable handle portion has an external screw threaded engagement with the internal screw thread and releasably securing the movable handle portion to the first handle portion, whereby the ram is movable along the toothpaste chamber by relative rotation of the first and second handle portions to expel the toothpaste from the toothpaste chamber through the passage to the outlet openings and whereby the second handle portion is separable from the first handle portion by unscrewing the external thread from the internal thread.

BRIEF DESCRIPTION OF THE DRAWINGS

Further features, advantages and objects of the present invention will be more readily apparent from the following description of a preferred embodiment thereof illustrated, by way of example, in the accompanying drawings, in which.

DESCRIPTION OF THE PREFERRED EMBODIMENT

Figure 1:
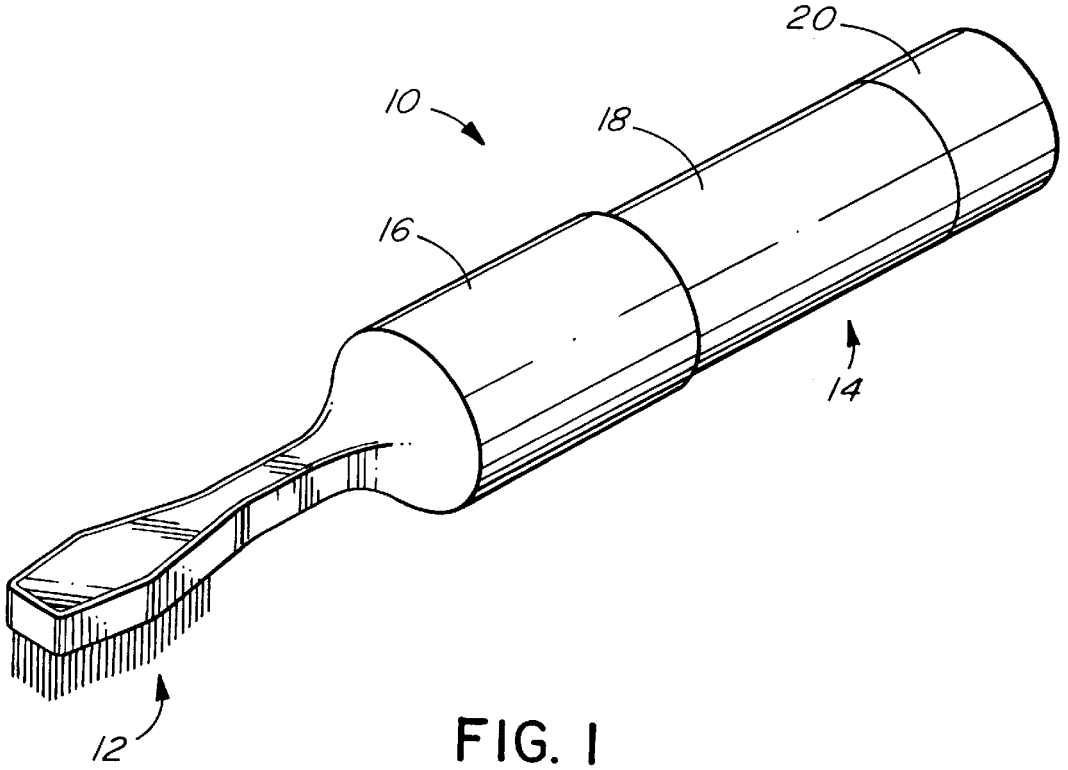
FIG. 1 shows a view in perspective of a toothbrush embodying the present invention.

In the accompanying drawings, reference numeral 10 indicates generally a toothbrush, which has a bristle end portion indicated generally by reference numeral 12 and a handle indicated generally by reference numeral 14.

The handle 14 comprises a first handle portion 16, which is formed in one piece with the bristle end portion 12, and a movable second handle portion, which is longitudinally displaceable relative to the first handle portion and which comprises an intermediate handle part 18 and an end handle part 20.

The bristle end portion 12 comprises a stem 22 forming a longitudinal extension of the handle 14, and bristles indicated generally by reference numeral 24, which project laterally from one side of the stem 22.

A cylindrical passage 26 extends longitudinally of the stem 22 from the handle 14 to a location close to the bristles 24, and the stem 22 is also formed with a plurality of transverse outlet openings 28 communicating with the passage 22 and opening to the exterior of the toothbrush between the bristles 24.

The first portion 16 of the handle 14 is hollow and contains toothpaste chamber 30, which contains a supply of toothpaste 32 in a scaled pouch 34 of flexible plastic sheet material.

The first portion 16 of the handle 14 also has a tube 36, which projects into the toothpaste chamber 30 and forms an extension of the passage 26. The tube 36 has a tapered end 38 which, as can be seen from FIG. 2, pierces the pouch 34 and, thus, provides communication between the supply of toothpaste 32 and the outlet openings 28 through the passage 26.

The intermediate part 18 of the movable second portion of the handle 14 is formed at one end thereof as a pressure member in the form of a piston or ram 40, which is inserted into an open end 42 of the first portion 16 of the handle 14.

The ram 40 is a screw ram which has an external screw thread 44 in threaded engagement with an internal screw thread 46, which is formed in the first portion 16 and which extends longitudinally along the hollow interior of the first portion 16 and, thus, along at least a portion of the length of the toothpaste chamber 30, which is cylindrical.

Figure 2:
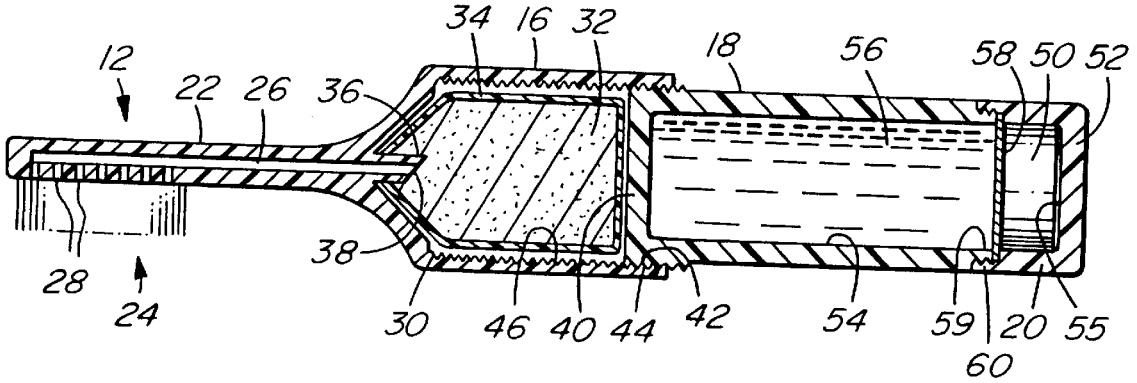
FIG. 2 shows a view taken in vertical longitudinal cross-section through the toothbrush of FIG. 1.
Figure 3:
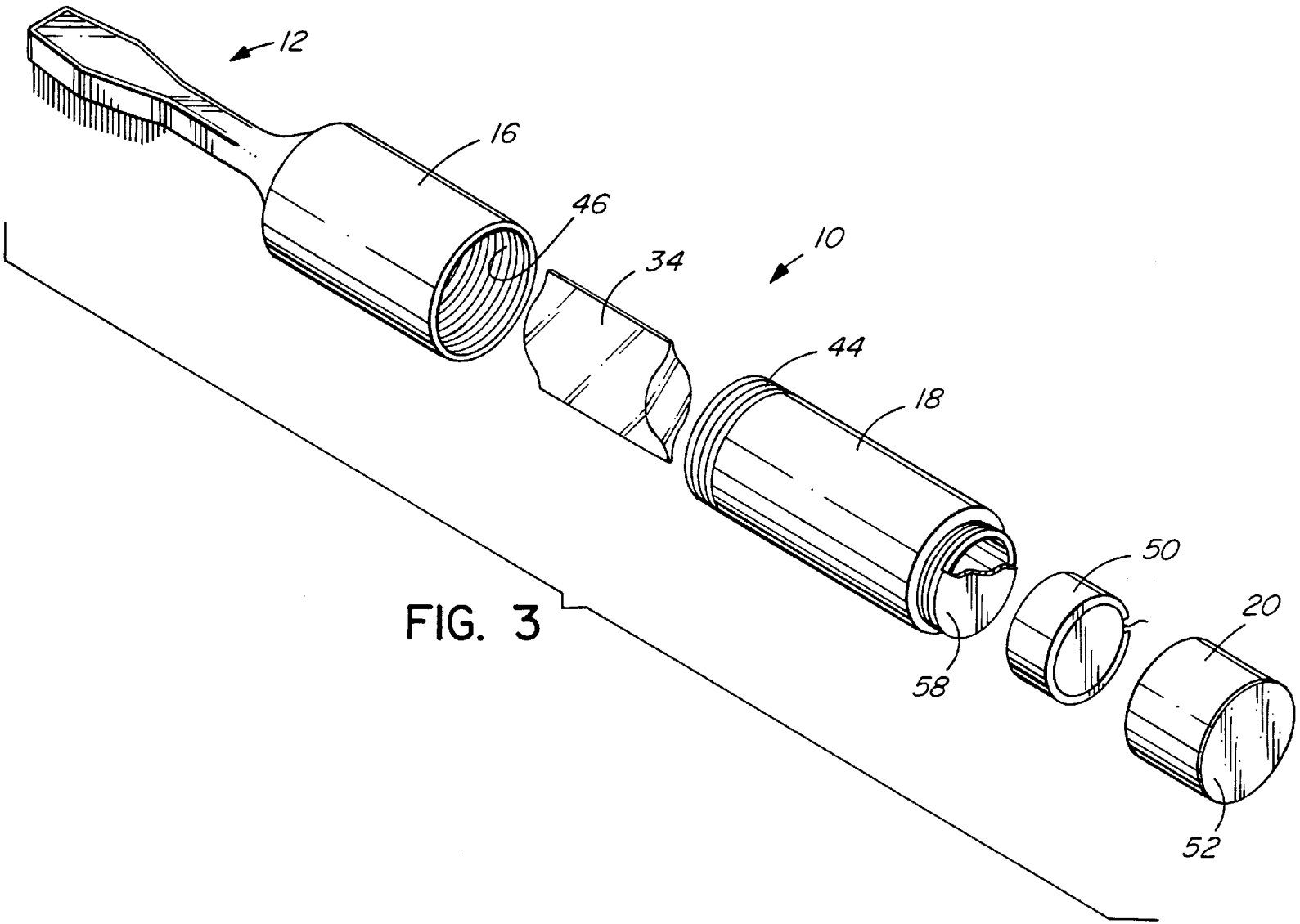
FIG. 3 shows an exploded view, in perspective, of the components of the toothbrush of FIG. 1.

As can be seen from FIG. 2, the intermediate part 18 of the handle has, along its length, an external diameter which is less than the internal diameter of the cylindrical toothpaste chamber 30. This enables the ram 40 to be displaced longitudinally through the toothpaste chamber 30, almost as far as the tapered end 38 of the tube 36, by relative rotation of the first and second portions of the handle 14 and the consequential screw action of the screw threads 44 and 46.

The intermediate part 18 also contains a mouthwash chamber 54, in which there is provided a supply 56 of mouthwash. The chamber 54 has at one end an opening which is closed by a removable circular foil seal 58 for retaining the supply of mouthwash 56 in the mouthwash chamber 54 until it is required for use.

The end part 20 of the handle portion is a hollow cylindrical member which is closed at one end by an end wall 52 and which contains a cylindrical floss chamber 55 containing a supply 50 of dental floss.

The intermediate part 18 and the end part 20 have end portions 59 and 60 which are mutually interengaged, by screw threads thereon in threaded engagement with one another, so as to releasably secure the parts 18 and 20 together in end-to-end relation.

As will be readily apparent to those skilled in the art, various modifications may be made in the above-described embodiment of the present invention within the scope of the appended claims.

For example, instead of employing the above-described screw threads 44 and 46 for expelling the toothpaste 32 from the chamber 30, the first part 16 of the handle could be modified so as to include a longitudinally collapsible container section for that purpose.

I claim:

1. A toothbrush, comprising, a handle and an elongate bristle end portion extending from said handle;

said bristle end portion having bristles projecting laterally thereform, a passage extending longitudinally of said bristle end portion and outlet openings extending transversely of said bristle end portion from said passage to locations between said bristles and communicating with the exterior of said bristle end portion;

said handle comprising a first handle portion connected to said bristle end portion and defining a toothpaste chamber communicating with said passage; and said first handle portion having an end opening at an end thereof remote from said bristle end portion, a sealed pouch accommodated in said toothpaste chamber and containing a supply of toothpaste and a tube forming an extension of said passage, said tube having a tapered end projecting into said toothpaste chamber so as to pierce said pouch and thereby provide communication between said passage and said supply of toothpaste;

said handle including a movable handle portion projecting longitudinally through said end opening;

said movable handle portion comprising a ram forming an end of said movable handle portion and located in said toothpaste chamber and said movable handle portion being provided with a mouthwash chamber, a supply of mouthwash in said mouthwash chamber, a floss chamber and a supply of floss in said floss chamber; and said first handle portion having an internal screw thread extending from said end opening and along said toothpaste chamber and said movable handle portion having an external screw thread in threaded engagement with said internal screw thread and releasably securing said moveable handle portion to said first handle portion, whereby said ram is movable along said toothpaste chamber by relative rotation of said first and second handle portions to expel said toothpaste from said toothpaste chamber through said passage to said outlet openings and whereby said second handle portion is separable from said first handle portion by unscrewing said external thread from said internal thread.

2. A toothbrush as claimed in claim 1, wherein said movable handle portion comprising two relatively separable parts, said parts having mutually interengageable end portions releasably securing said parts together in end-to-end relation, one of said parts containing said mouthwash chamber and the other of said parts containing said floss chamber.

* * * * *